US010273954B2

(12) United States Patent
Brown et al.

(10) Patent No.: US 10,273,954 B2
(45) Date of Patent: Apr. 30, 2019

(54) FLUID END OF A RECIPROCATING PUMP WITH REDUCED STRESS

(71) Applicant: Black Horse, LLC, Houston, TX (US)

(72) Inventors: Jacob Brown, Rapid City, SD (US); James Anthony Barnhouse, Jr., Spring, TX (US); Daryl Belshan, Tremont, IL (US)

(73) Assignee: BLACK HORSE, LLC, Houston, TX (US)

( * ) Notice: Subject to any disclaimer, the term of this patent is extended or adjusted under 35 U.S.C. 154(b) by 199 days.

(21) Appl. No.: 15/379,793

(22) Filed: Dec. 15, 2016

(65) Prior Publication Data

US 2018/0171999 A1 Jun. 21, 2018

(51) Int. Cl.

| | |
|---|---|
| ***F04B 53/16*** | (2006.01) |
| ***F16K 15/02*** | (2006.01) |
| ***F04B 1/04*** | (2006.01) |
| ***F04B 1/053*** | (2006.01) |
| *E21B 43/26* | (2006.01) |

(52) U.S. Cl.

CPC ..... *F04B 53/162* (2013.01); *F04B 1/0448* (2013.01); *F04B 1/053* (2013.01); *F04B 1/0536* (2013.01); *F04B 53/16* (2013.01); *F04B 53/164* (2013.01); *F16K 15/025* (2013.01); *E21B 43/26* (2013.01)

(58) Field of Classification Search

CPC ..... F04B 53/162

See application file for complete search history.

(56) References Cited

U.S. PATENT DOCUMENTS 5,073,096 A * 12/1991 King ..... F04B 53/007 137/516.29

6,910,871 B1 * 6/2005 Blume ..... F04B 53/007 137/512

2016/0208797 A1 7/2016 Ladd et al.

FOREIGN PATENT DOCUMENTS

WO 2015/179839 A1 11/2015

* cited by examiner

*Primary Examiner* — F Daniel Lopez

(74) *Attorney, Agent, or Firm* — MH2 Technology Law Group LLP

(57) ABSTRACT

A fluid end of a pump includes a body that defines a suction bore, a discharge bore, and a plunger bore. A first central longitudinal axis extends through the suction bore, the discharge bore, or both. A second central longitudinal axis extends through the plunger bore. A chamber is defined at an intersection between the suction bore, the discharge bore, and the plunger bore. An interior surface of the body that at least partially defines the chamber comprises a first wall portion that is at least partially planar and oriented at an angle that is less than or equal to 15° from perpendicular to the first central longitudinal axis.

21 Claims, 6 Drawing Sheets

FLUID END OF A RECIPROCATING PUMP WITH REDUCED STRESS

BACKGROUND

Hydraulic fracturing is a well-stimulation technique in which a high-pressure fluid is injected downhole to fracture a subterranean rock. More particularly, hydraulic fracturing involves injecting a high-pressure fluid into a wellbore to create cracks in the rock through which hydrocarbons (e.g., natural gas, petroleum) may flow into the wellbore more freely. The injected fluid may be pressurized by a pump at the surface. The pump may be, for example, a reciprocating pump that includes a power end and a fluid end. The fluid end includes a housing that defines a chamber. One or more plungers may move in a first direction, allowing a lower pressure fluid to flow into the chamber. The one or more plungers may then move in a second, opposing direction, which reduces the volume of the chamber and causes the fluid to flow out to the wellhead. When the flow area in the well is saturated, higher pressure is needed to push the flow through the restrictions caused by the rock formations, thus causing the pressure of the fluid in the chamber to increase.

The cyclical hydraulic pressures in the chamber may strain the housing. This strain may lead to the initiation of cracks in the inner surface of the housing around the chamber. As the cracks propagate, the cracks may lead to the end of the useful life of the fluid end of the pump. In addition, the fluid that is pressurized in the chamber may include water, chemicals, and proppant that, while useful in the fracturing process, may accelerate the formation and propagation of the cracks in the housing. Thus, what is needed is an improved fluid end of a pump that is more resistant to cracks to increase the useful life of the fluid end of the pump.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A fluid end of a pump includes a body that defines a suction bore, a discharge bore, and a plunger bore. A first central longitudinal axis extends through the suction bore, the discharge bore, or both. A second central longitudinal axis extends through the plunger bore. A chamber is defined at an intersection between the suction bore, the discharge bore, and the plunger bore. An interior surface of the body that at least partially defines the chamber comprises a first wall portion that is at least partially planar and oriented at an angle that is less than or equal to 15° from perpendicular to the first central longitudinal axis.

In another embodiment, the fluid end of the pump includes a body that defines a suction bore, a discharge bore, and a plunger bore. A first central longitudinal axis extends through the suction bore, the discharge bore, or both. A second central longitudinal axis extends through the plunger bore. A chamber is defined at an intersection between the suction bore, the discharge bore, and the plunger bore. An interior surface of the body that at least partially defines the chamber comprises a first wall portion that is at least partially planar and oriented at an angle that is less than or equal to 15° from perpendicular to the second central longitudinal axis.

In yet another embodiment, the fluid end of the pump includes a body that defines a suction bore, a discharge bore, and a plunger bore. A first central longitudinal axis extends through the suction bore, the discharge bore, or both. A second central longitudinal axis extends through the plunger bore. A chamber is defined at an intersection between the suction bore, the discharge bore, and the plunger bore. An interior surface of the body that at least partially defines the chamber comprises a first wall portion that is at least partially planar and oriented at an angle that is less than or equal to 15° from parallel to the first and second central longitudinal axes.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
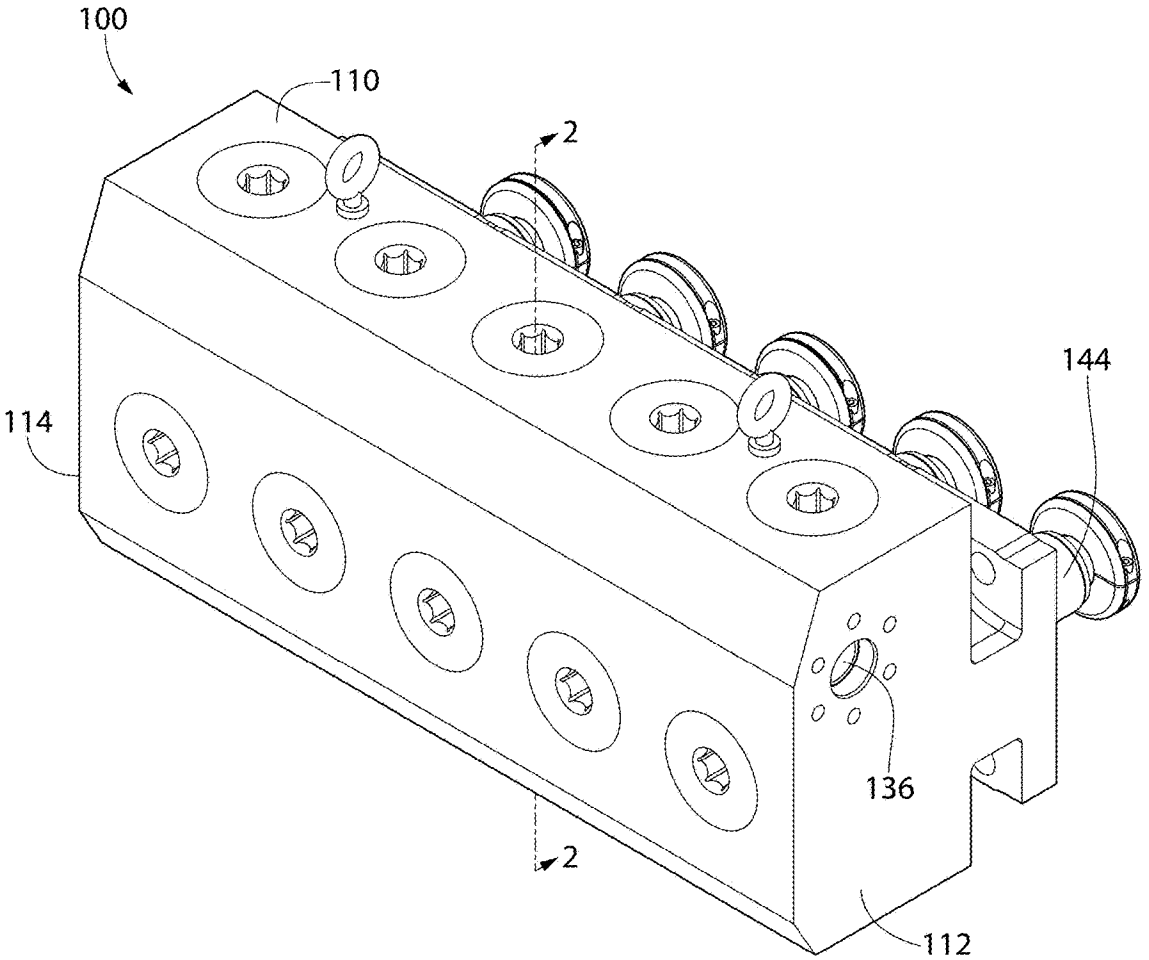
FIG. 1 illustrates a perspective view of a fluid end of a pump, according to an embodiment.

FIG. 1 illustrates a perspective view of a fluid end 100 of a pump, according to an embodiment. The fluid end 100 may include a body (also referred to as a block) 110. The body 110 may be made of steel (e.g., alloy steel). One or more plungers (five are shown: 144) may be positioned at least partially within the body 110. The plungers 144 may also be coupled to a power end of the pump (not shown), which may cause the plungers 144 to move axially back and forth (i.e., reciprocate) within the body 110.

Figure 2:
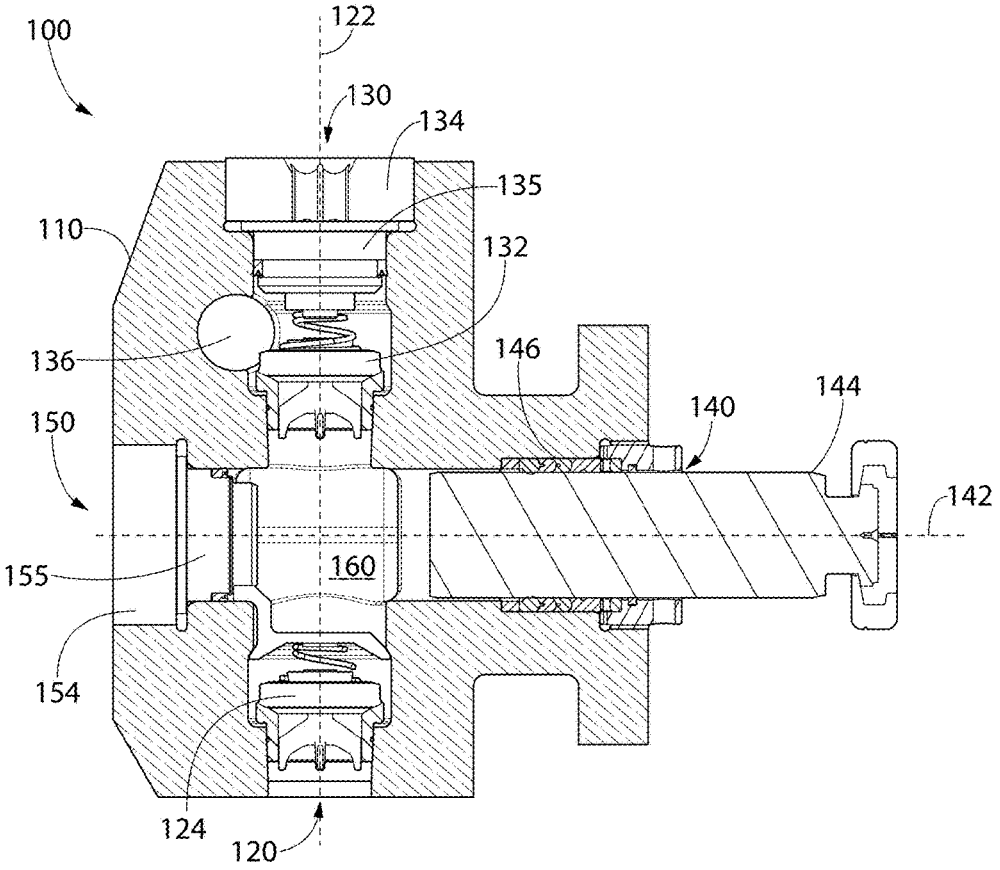
FIG. 2 illustrates a cross-sectional side view of the fluid end taken through line 2-2 in FIG. 1, according to an embodiment.

FIG. 2 illustrates a cross-sectional side view of the fluid end 100 taken through line 2-2 in FIG. 1, according to an embodiment. The body 110 may define intersecting bores. More particularly, the body 110 may define a suction bore 120, a discharge bore 130, a plunger bore 140, and an access bore 150. The suction bore 120 and the discharge bore 130 may be aligned such that they share a common central longitudinal axis 122. The plunger bore 140 and the access bore 150 may also be aligned such that they share a common central longitudinal axis 142. The central longitudinal axis 122 through the suction bore 120 and the discharge bore 130 may be substantially perpendicular to the central longitudinal axis 142 through the plunger bore 140 and the access bore 150. A chamber 160 may be positioned at the intersection of the bores 120, 130, 140, 150. The chamber 160 may be or include the volume where the bores 120, 130, 140, 150 overlap.

A first check valve 124 may be positioned in the suction bore 120. The first check valve 124 may allow fluid to flow therethrough in one direction but prevent the fluid from flowing therethrough in the opposing direction. More particularly, fluid may flow upward through the first check valve 124 and into the chamber 160 when a pressure differential across the first check valve 124 exceeds a predetermined amount.

A second check valve 132 may be positioned in the discharge bore 130. The second check valve 132 may also allow fluid to flow therethrough in one direction but prevent the fluid from flowing therethrough in the opposing direction. More particularly, the fluid may flow upward through the second check valve 132 to exit the chamber 160 when a pressure differential across the second check valve 132 exceeds a predetermined amount.

A nut 134 and discharge cover 135 may also be positioned at least partially in the discharge bore 130. The nut 134 and discharge cover 135 may retain the fluid and allow for access into the body 110. A nut 154 and access cover 155 may be positioned at last partially in the access bore 150. The nut 154 and access cover 155 may retain the fluid and allow for access into the body 110.

The plunger 144 may be positioned at least partially in the plunger bore 140. As described above, an end of the plunger 144 may be coupled to the power end of the pump, which may cause the plunger 144 to move axially back and forth (i.e., reciprocate) within the plunger bore 140. One or more seals 146 may be positioned (e.g., radially) between the plunger 144 and the body 110. A lower pressure fluid is available in bore suction 120, and when the plunger 144 moves away from the chamber 160 (e.g., to the right in FIG. 2), a pressure differential is created across the first check valve 124. This may cause the fluid to flow from the suction bore 120, through the first check valve 124, and into the chamber 160. When the plunger 144 then moves back toward the chamber 160 (e.g., to the left in FIG. 2), a pressure differential is created across the second check valve 132. This may cause the fluid to flow from the chamber 160, through the second check valve 132, through the discharge bore 130, and out the discharge rail 136. The pressurized fluid may then be introduced into a wellbore after it exits the fluid end 100.

Figure 3:
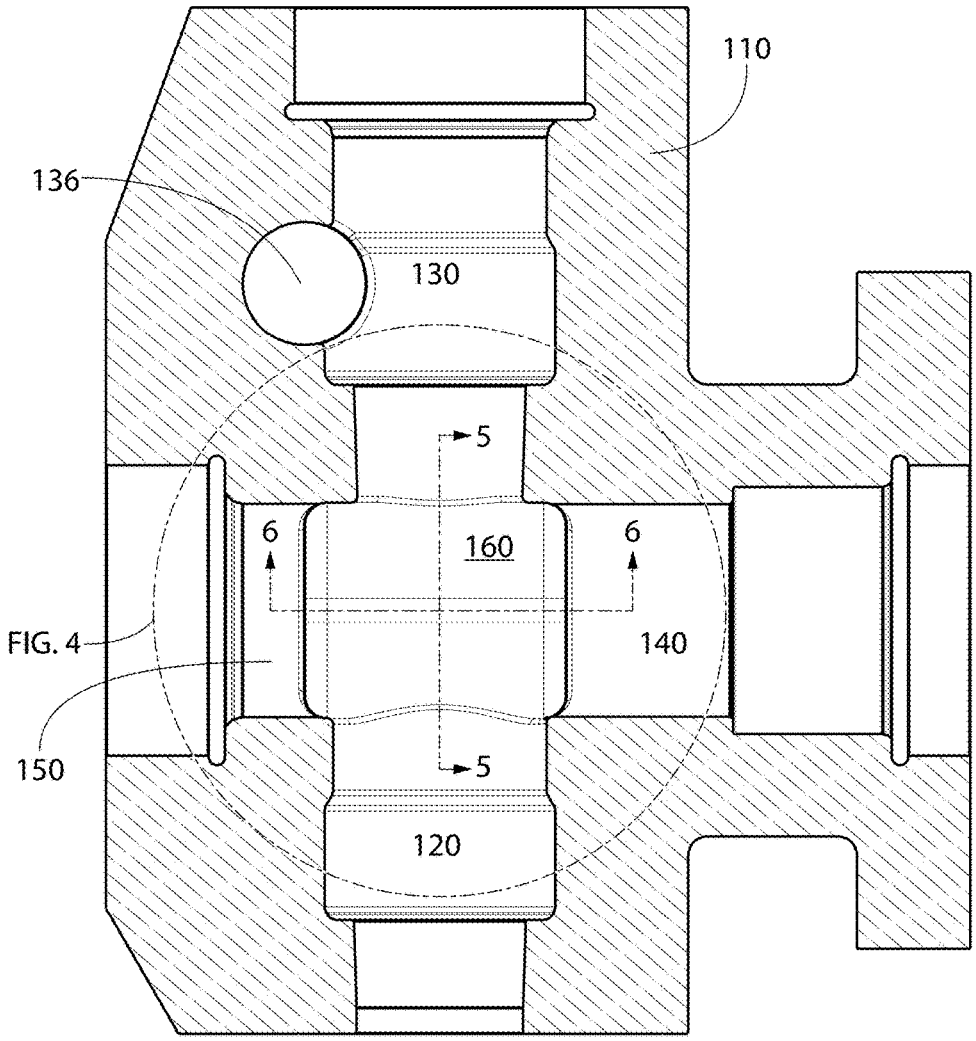
FIG. 3 illustrates the cross-sectional side view of the fluid end shown in FIG. 2 with the internal components removed, according to an embodiment.

FIG. 3 illustrates the cross-sectional side view of the fluid end 100 shown in FIG. 2 with the internal components (e.g., check valves 124, 132, nuts 134, 154, covers 135, 155, and seals 146) removed for clarity, according to an embodiment. The inner surfaces of the body 110 that define the chamber 160 may be created or modified (e.g., milled, machined, etc.) to reduce the stress experienced by the body 110 in response to the cyclical fluctuations of hydraulic pressure. As described in greater detail below, according to an embodiment, the creations or modifications may reduce stress experienced on the inner surface of the body 110 up to about 40%. By creating a larger chamber 160 of this particular geometry, the body 110 is able to flex more and thus allows the stress to distribute more than conventional designs. Also by creating one or more planar surfaces, the intersecting bore is able to break through on a flatter surface rather than a curved surface, distributing the stress more evenly.

Figure 4:
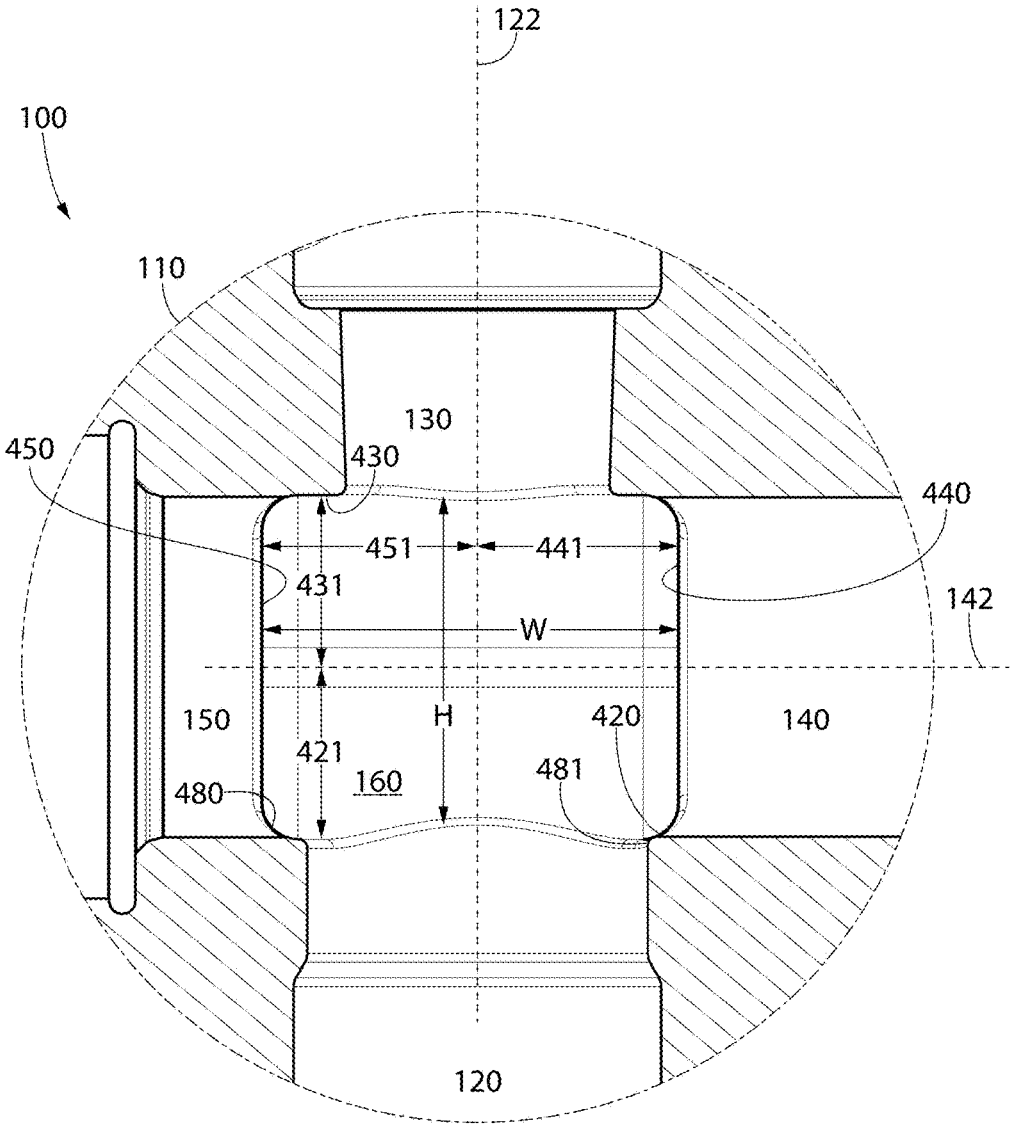
FIG. 4 illustrates an enlarged cross-sectional side view of a portion of the fluid end shown in FIG. 3, according to an embodiment.
Figure 5:
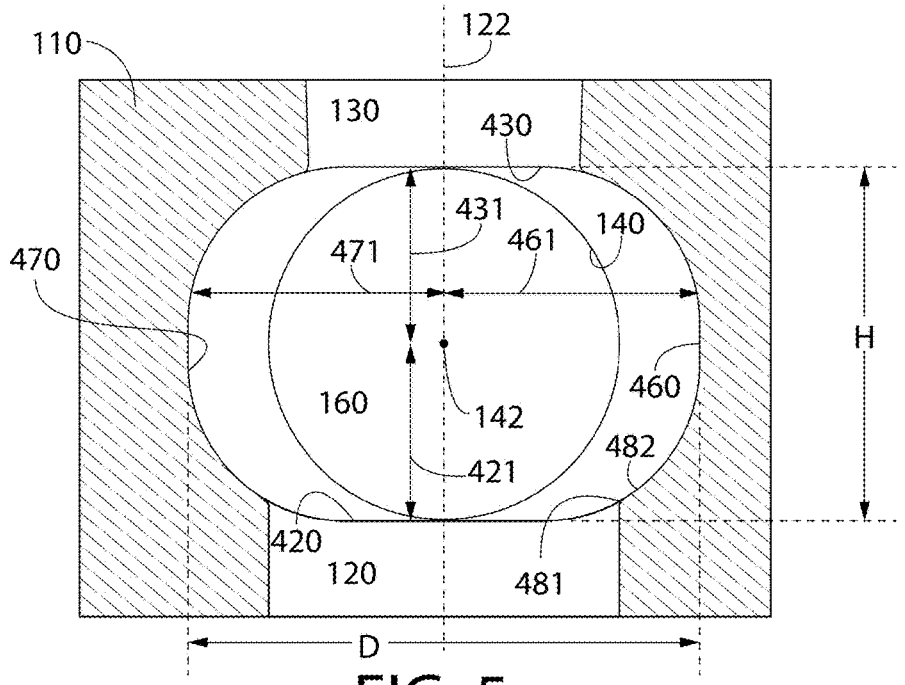
FIG. 5 illustrates another enlarged cross-sectional side view of a portion of the fluid end taken through line 5-5 in FIG. 3, according to an embodiment.

FIG. 4 illustrates an enlarged cross-sectional side view of a portion of the fluid end 100 shown in FIG. 3, according to an embodiment. The chamber 160 maybe be defined at least partially by one or more (e.g., six) wall portions: (a suction wall portion 420, a discharge wall portion 430, a plunger wall portion 440, an access wall portion 450, a first side wall portion 460, and a second side wall portion 470). Only the suction wall portion 420, the discharge wall portion 430, the plunger wall portion 440, and the access wall portion 450 may be seen in FIG. 4. The first side wall portion 460 and the second side wall portion 470 are shown in FIG. 5. One or more of the wall portions 420, 430, 440, 450, 460, 470 may be at least partially planar.

The planar portions of the suction wall portion 420 and/or the discharge wall portion 430 may be substantially perpendicular to the central longitudinal axis 122 and/or substantially parallel to the central longitudinal axis 142. For example, the planar portions of the suction wall portion 420 and/or the discharge wall portion 430 may be less than or equal to about 15°, less than or equal to about 10°, less than or equal to about 5°, or less than or equal to about 1° from perpendicular to the central longitudinal axis 122 and/or parallel to the central longitudinal axis 142

An average distance 421 between the central longitudinal axis 142 and the planar portion of the suction wall portion 420 may be from about 1 inch to about 6 inches, about 1.75 inches to about 4 inches, or about 2.5 inches to about 3.5 inches. Similarly, an average distance 431 between the central longitudinal axis 142 and the planar portion of the discharge wall portion 430 may be from about 1 inch to about 6 inches, about 1.75 inches to about 4 inches, or about 2.5 inches to about 3.5 inches. The average distance 421 plus (+) the average distance 431 may be referred to as a height H of the chamber 160. A ratio of the average distance 421 or the average distance 431 to a smallest diameter of the plunger bore 140 and/or the access bore 150 may be from about 2:5 to about 1:1.

The planar portions of the plunger wall portion 440 and/or the access wall portion 450 may be substantially parallel to the central longitudinal axis 122 and/or substantially perpendicular to the central longitudinal axis 142. For example, the planar portions of the plunger wall portion 440 and/or the access wall portion 450 may be less than or equal to about 15°, less than or equal to about 10°, less than or equal to about 5°, or less than or equal to about 1° from parallel to the central longitudinal axis 122 and/or perpendicular to the central longitudinal axis 142.

An average distance 441 between the central longitudinal axis 122 and the planar portion of the plunger wall portion 440 may be from about 1 inch to about 6 inches, about 2 inches to about 5 inches, or about 3 inches to about 4 inches. Similarly, an average distance 451 between the central longitudinal axis 122 and the planar portion of the access wall portion 450 may be from about 1 inch to about 6 inches, about 2 inches to about 5 inches, or about 3 inches to about 4 inches. The average distance 441 plus (+) the average distance 451 may be referred to as a width W of the chamber 160. A ratio of the average distance 441 or the average distance 451 to a smallest diameter of the suction bore 120 and/or the discharge bore 130 may be from about 1:4 to about 7:5.

A radius 480 may exist between the suction wall portion 420 and the plunger wall portion 440, between the suction wall portion 420 and the access wall portion 450, between the discharge wall portion 430 and the plunger wall portion 440, and/or between the discharge wall portion 430 and the access wall portion 450. The radius 480 may be the same or different between any two of these wall portions 420, 430, 440, 450. The radius 480 may be less than about 1.5 inches, less than about 2 inches, or about 0.1 inches to about 2.5 inches.

A radius 481 may exist between the suction bore 120 and the suction wall portion 420 and/or between the discharge bore 130 and the discharge wall portion 430. The radius 481 may be less than about 0.8 inches, less than about 1.0 inch, or about 0.1 inches to about 1.2 inches.

FIG. 5 illustrates another enlarged cross-sectional side view of a portion of the fluid end 100 taken through line 5-5 in FIG. 3, according to an embodiment. FIGS. 4 and 5 are both side views that are offset from one another by 90°. FIG. 5 shows the suction wall portion 420, the discharge wall portion 430, the first side wall portion 460, and the second side wall portion 470. The planar portions of the first side wall portion 460 and/or the second side wall portion 470 may be substantially parallel to the central longitudinal axes 122, 142. For example, the planar portions of the first side wall portion 460 and/or the second side wall portion 470 may be less than or equal to about 15°, less than or equal to about 10°, less than or equal to about 5°, or less than or equal to about 1° from parallel to the central longitudinal axes 122, 142.

An average distance 461 between the central longitudinal axes 122, 142 and the planar portion of the first side wall portion 460 may be from about 1 inch to about 5 inches, about 2 inches to about 4 inches, or about 2.5 inches to about 3.5 inches. Similarly, an average distance 471 between the central longitudinal axes 122, 142 and the planar portion of the second side wall portion 470 may be from about 1 inch to about 5 inches, about 2 inches to about 4 inches, or about 2.5 inches to about 3.5 inches. The average distance 461 plus (+) the average distance 471 may be referred to as a depth D of the chamber 160. A ratio of the average distance 461 or the average distance 471 to a smallest diameter of the plunger bore 140 and/or the access bore 150 may be from about 1:2 to about 5:4.

The first side wall portion 460 and/or the second side wall portion 470 may include a radius 482 between the suction bore 120 and the discharge bore 130. The radius 482 may be from about 0.25 inches to about 5 inches, about 0.5 inches to about 4 inches, or about 1 inch to about 3 inches. A ratio of the radius 482 to the smallest diameter of the plunger bore 140 may be from about 1:16 to about 3:5. As discussed in greater detail below, in addition to including the radius 482, the first side wall portion 460 and/or the second side wall portion 470 may also be at least partially planar.

Figure 6:
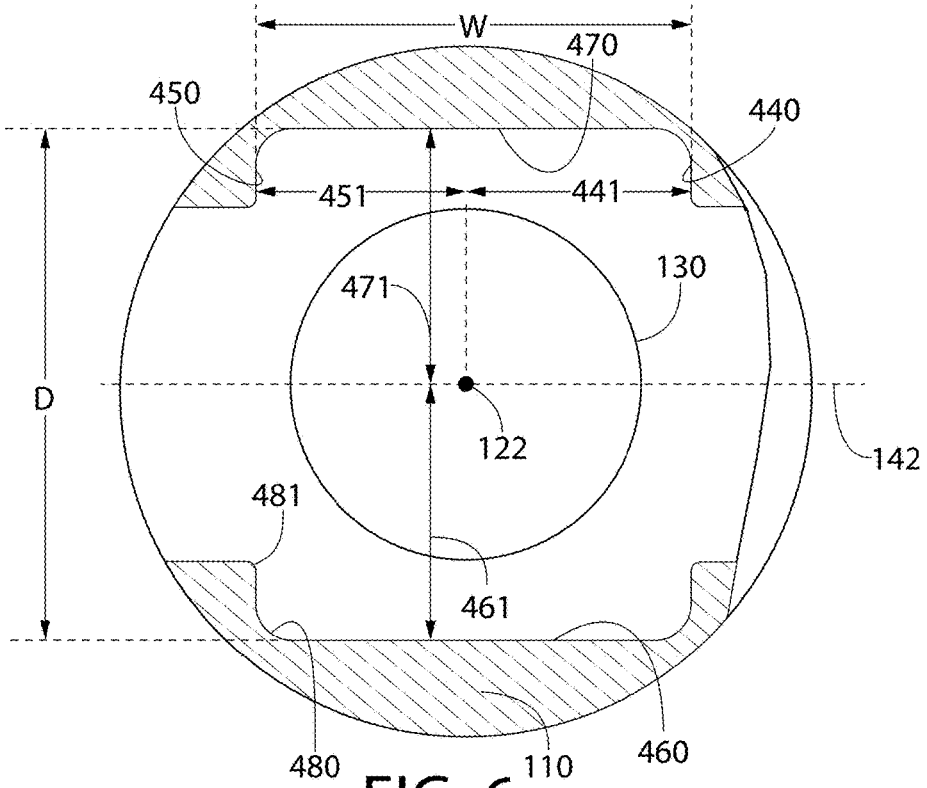
FIG. 6 illustrates yet another enlarged cross-sectional side view of a portion of the fluid end taken through line 6-6 in FIG. 3, according to an embodiment.

FIG. 6 illustrates yet another enlarged cross-sectional side view of a portion of the fluid end 100 showing the chamber 160 taken through line 6-6 in FIG. 3, according to an embodiment. FIG. 6 shows the plunger wall portion 440, the access wall portion 450, the first side wall portion 460, and the second side wall portion 470.

The radius 480 (from FIG. 4) may also exist between the plunger wall portion 440 and the first side wall portion 460, between the plunger wall portion 440 and the second side wall portion 470, between the plunger wall portion 440 and the radius 482, between the access wall portion 450 and the first side wall portion 460, between the access wall portion 450 and the second side wall portion 470, and/or between the access wall portion 450 and the radius 482. The radius 480 may be the same or different between any two of these wall portions 440, 450, 460, 470 or the radius portion 482.

The radius 481 (from FIG. 4) may also exist between the plunger bore 140 and the plunger wall portion 440 and/or between the access bore 150 and the access wall portion 450. The radius 481 may be less than about 0.5 inches, less than about 1.0 inch, or about 0.1 inches to about 1.5 inches.

Figure 7:
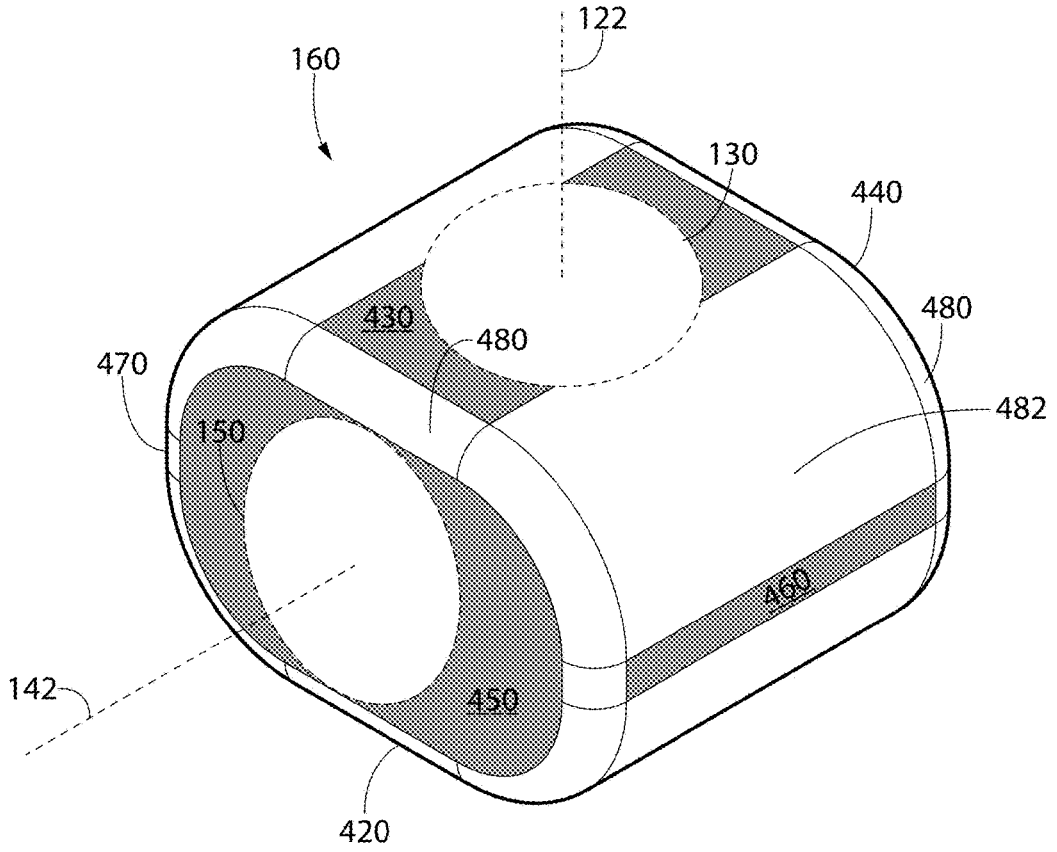
FIG. 7 illustrates a perspective view of the wall portions of the body that define the chamber, according to an embodiment.

FIG. 7 illustrates a perspective view of the wall portions surrounding the chamber 160 (i.e., showing a perspective view of a shape of the chamber 160), according to an embodiment. The planar portions of the discharge wall portion 430, the access wall portion 450, and the first side wall portion 460 are shaded to make them easier for the reader to identify. Although not shown, in at least one embodiment, the planar portion of the suction wall portion 420 may be a mirror image of the planar portion of the discharge wall portion 430. Although not shown, in at least one embodiment, the planar portion of the plunger wall portion 440 may be a mirror image of the planar portion of the access wall portion 450. Although not shown, in at least one embodiment, the planar portion of the second side wall portion 470 may be a mirror image of the planar portion of the first side wall portion 460.

As discussed above, the planar portions of the suction wall portion 420 and the discharge wall portion 430 may be substantially perpendicular to the central longitudinal axis 122 and substantially parallel to the central longitudinal axis 142. The planar portions of the plunger wall portion 440 and the access wall portion 450 may be substantially parallel to the central longitudinal axis 122 and substantially perpendicular to the central longitudinal axis 142. The planar portions of the first side wall portion 460 and the second side wall portion 470 may be substantially parallel to the central longitudinal axes 122, 142.

Conventional fluid ends may experience greater levels of stress than the fluid end 100 proximate to the intersection of the bores 120, 130, 140, 150. For example, when the fluid is pressurized, a stress in the conventional fluid end is experienced. When the fluid reaches a similar pressure in the fluid end 100, however, the stress is only about 59% of the stress experienced by the conventional fluid end. This is due to the shape and size of the wall portions defining the chamber 160. This has reduced the stress concentration in the body 110. As a result, the fluid end 100 may be less likely to have cracks form and propagate therein when compared to a conventional fluid end. This may increase the useful life of the fluid end 100.

Simulated Stress Results

Table 1 below shows simulated stress results as the dimensions (e.g., variables) of the chamber 160 vary. The first simulation corresponds to a conventional chamber having a certain stress level (e.g., 100%) in response to a predetermined fluid pressure. The ninth simulation corresponds to the chamber 160 of the body 110, having a stress of level of about 59% of simulation 1, in response to the same predetermined fluid pressure. The other simulations illustrate how the stress levels vary in response to modifying different variables.

TABLE 1

| Simulation | Distance 451 | Distance 441 | Curved Transition 482 | Curved Transition 480 | Depth D | Height H | Percent Stress |
|---|---|---|---|---|---|---|---|
| 1 | n/a | n/a | n/a | n/a | n/a | n/a | 100 |
| 2 | 2.5 | 3 | 2.25 | 0.5 | 7 | 5 | 71 |
| 3 | 3 | 3 | 2.25 | 0.5 | 7 | 5 | 61 |
| 4 | 3.5 | 3 | 2.25 | 0.5 | 7 | 5 | 63 |
| 5 | 4 | 3 | 2.25 | 0.5 | 7 | 5 | 64 |

TABLE 1-continued

| Simulation | Distance 451 | Distance 441 | Curved Transition 482 | Curved Transition 480 | Depth D | Height H | Percent Stress |
|---|---|---|---|---|---|---|---|
| 6 | 3 | 2.5 | 2.25 | 0.5 | 7 | 5 | 66 |
| 7 | 3 | 3.5 | 2.25 | 0.5 | 7 | 5 | 63 |
| 8 | 3 | 3 | 1.875 | 0.5 | 7 | 5 | 61 |
| 9 | 3 | 3 | 2 | 0.5 | 7 | 5 | 59 |
| 10 | 3 | 3 | 2.125 | 0.5 | 7 | 5 | 61 |
| 11 | 3 | 3 | 2 | 0.25 | 7 | 5 | 88 |
| 12 | 3 | 3 | 2 | 0.75 | 7 | 5 | 60 |
| 13 | 3 | 3 | 2 | 1 | 7 | 5 | 61 |
| 14 | 3 | 3 | 2 | 0.5 | 6 | 5 | 69 |
| 15 | 3 | 3 | 2 | 0.5 | 6.5 | 5 | 64 |
| 16 | 3 | 3 | 2 | 0.5 | 7.5 | 5 | 66 |
| 17 | 3 | 3 | 2 | 0.5 | 7 | 4.5 | 79 |
| 18 | 3 | 3 | 2 | 0.5 | 7 | 4.75 | 61 |
| 19 | 3 | 3 | 2 | 0.5 | 7 | 5.25 | 60 |
| 20 | 3 | 3 | 2 | 0.5 | 7 | 5.5 | 62 |

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A fluid end of a pump, comprising:

a body defining:

a suction bore;

a discharge bore, wherein a first central longitudinal axis extends through the suction bore, the discharge bore, or both; and a plunger bore, wherein a second central longitudinal axis is not parallel to the first central longitudinal axis and extends through the plunger bore, wherein a chamber is defined at an intersection between the suction bore, the discharge bore, and the plunger bore, and wherein an interior surface of the body that at least partially defines the chamber comprises a first side wall portion that is planar and substantially parallel to the first and second central longitudinal axes.

2. The fluid end of claim 1, wherein a distance between the first central longitudinal axis and the first side wall portion is from about 1 inch to about 5 inches, and wherein a distance between the second central longitudinal axis and the first side wall portion is from about 1 inch to about 5 inches.

3. The fluid end of claim 1, wherein the interior surface of the body that at least partially defines the chamber also comprises a second side wall portion that is planar and substantially parallel to the first and second central longitudinal axes, and wherein the chamber is positioned at least partially between the first side wall portion and the second side wall portion.

4. The fluid end of claim 1, wherein the interior surface of the body that at least partially defines the chamber also comprises a discharge wall portion that is planar and substantially perpendicular to the first central longitudinal axis.

5. The fluid end of claim 4, wherein a distance between the second central longitudinal axis and the discharge wall portion is from about 1 inch to about 6 inches.

6. The fluid end of claim 4, wherein a radius exists between the discharge wall portion and the first side wall portion, and wherein the radius is from about 0.25 inches to about 5 inches.

7. The fluid end of claim 1, wherein the interior surface of the body that at least partially defines the chamber also comprises a suction wall portion that is planar and substantially perpendicular to the first central longitudinal axis.

8. The fluid end of claim 7, wherein a distance between the second central longitudinal axis and the suction wall portion is from about 1 inch to about 6 inches.

9. The fluid end of claim 7, wherein a radius exists between the suction wall portion and the first side wall portion, and wherein the radius is from about 0.25 inches to about 5 inches.

10. A fluid end of a pump, comprising:

a body defining:

a suction bore;

a discharge bore, wherein a first central longitudinal axis extends through the suction bore, the discharge bore, or both; and a plunger bore, wherein a second central longitudinal axis is not parallel to the first central longitudinal axis and extends through the plunger bore, wherein a chamber is defined at an intersection between the suction bore, the discharge bore, and the plunger bore, and wherein an interior surface of the body that at least partially defines the chamber comprises:

a first side wall portion that is planar and substantially parallel to the first and second central longitudinal axes; and a discharge wall portion that is planar and substantially perpendicular to the first central longitudinal axis.

11. The fluid end of claim 10, wherein the interior surface of the body that at least partially defines the chamber also comprises a plunger wall portion that is planar and substantially perpendicular to the second central longitudinal axis.

12. The fluid end of claim 11, wherein a distance between the first central longitudinal axis and the plunger wall portion is from about 1 inch to about 6 inches.

13. The fluid end of claim 11, wherein a radius exists between the discharge wall portion and the plunger wall portion, and wherein the radius is from about 0.1 inches to about 2.5 inches.

14. The fluid end of claim 10, wherein a radius exists between the first side wall portion and the plunger wall portion, and wherein the radius is from about 0.1 inches to about 2.5 inches.

15. The fluid end of claim 10, wherein the interior surface of the body that at least partially defines the chamber also comprises an access wall portion that is planar and substantially perpendicular to the second central longitudinal axis.

16. The fluid end of claim 15, wherein a distance between the first central longitudinal axis and the access wall portion is from about 1 inch to about 6 inches.

17. The fluid end of claim 15, wherein a radius exists between the discharge wall portion and the access wall portion, and wherein the radius is from about 0.1 inches to about 2.5 inches.

18. The fluid end of claim 15, wherein a radius exists between the first side wall portion and the access wall portion, and wherein the radius is from about 0.1 inches to about 2.5 inches.

19. A fluid end of a pump, comprising:

a body defining:

a suction bore;

a discharge bore, wherein a first central longitudinal axis extends through the suction bore, the discharge bore, or both; and a plunger bore, wherein a second central longitudinal axis extends through the plunger bore, wherein the first and second central longitudinal axes are perpendicular to one another, wherein a chamber is defined at an intersection between the suction bore, the discharge bore, and the plunger bore, and wherein an interior surface of the body that at least partially defines the chamber comprises:

a suction wall portion that is planar and substantially perpendicular to the first central longitudinal axis;

a discharge wall portion that is planar and substantially perpendicular to the first central longitudinal axis;

a plunger wall portion that is planar and substantially perpendicular to the second central longitudinal axis;

an axis wall portion that is planar and substantially perpendicular to the second central longitudinal axis;

a first side wall portion that is planar and substantially parallel to the first and second central longitudinal axes; and a second side wall portion that is planar and substantially parallel to the first and second central longitudinal axes.

20. The fluid end of claim 19, wherein a radius exists between the suction wall portion and the access wall portion, and wherein the radius is from about 0.1 inches to about 2.5 inches.

21. The fluid end of claim 19, wherein a radius exists between the suction wall portion and the plunger wall portion, and wherein the radius is from about 0.1 inches to about 2.5 inches.

* * * * *